United States Patent [19]

Widmer

[11] 3,945,187

[45] Mar. 23, 1976

[54] TEXTILE SPINDLE

[75] Inventor: Dieter Widmer, Uster, Switzerland

[73] Assignee: Spindel-,Motoren- Und Maschinenfabrik A.G., Uster, Switzerland

[22] Filed: July 3, 1974

[21] Appl. No.: 485,672

[30] Foreign Application Priority Data

July 16, 1973 Germany ..... 2336113

[52] U.S. Cl. ..... 57/135; 308/155 R

[51] Int. Cl.[2] ..... D01H 7/12

[58] Field of Search ..... 57/129–135; 308/152, 154, 156, 155

[56] References Cited

UNITED STATES PATENTS

| | | | |
|---|---|---|---|
| 2,777,739 | 1/1957 | Beerli | 57/135 UX |
| 2,946,179 | 7/1960 | Kodama | 57/134 |
| 3,035,402 | 5/1962 | Westall et al. | 57/135 |
| 3,065,593 | 11/1962 | Westall et al. | 57/135 |
| 3,447,305 | 6/1969 | Stahlecker et al. | 57/132 |
| 3,797,219 | 3/1974 | Kieronski et al. | 57/135 |
| 3,798,888 | 3/1974 | Mandl | 57/135 |

*Primary Examiner*—John Petrakes

*Attorney, Agent, or Firm*—Ladas, Parry, Von Gehr, Goldsmith & Deschamps

[57] ABSTRACT

A textile spindle comprising a spindle housing supporting a collar bearing and a footstep bearing through the agency of elastic bearing elements formed of a yieldable or resilient material. The elastic bearing elements support a rigid bearing tube which houses the collar bearing and the footstep bearing.

9 Claims, 1 Drawing Figure

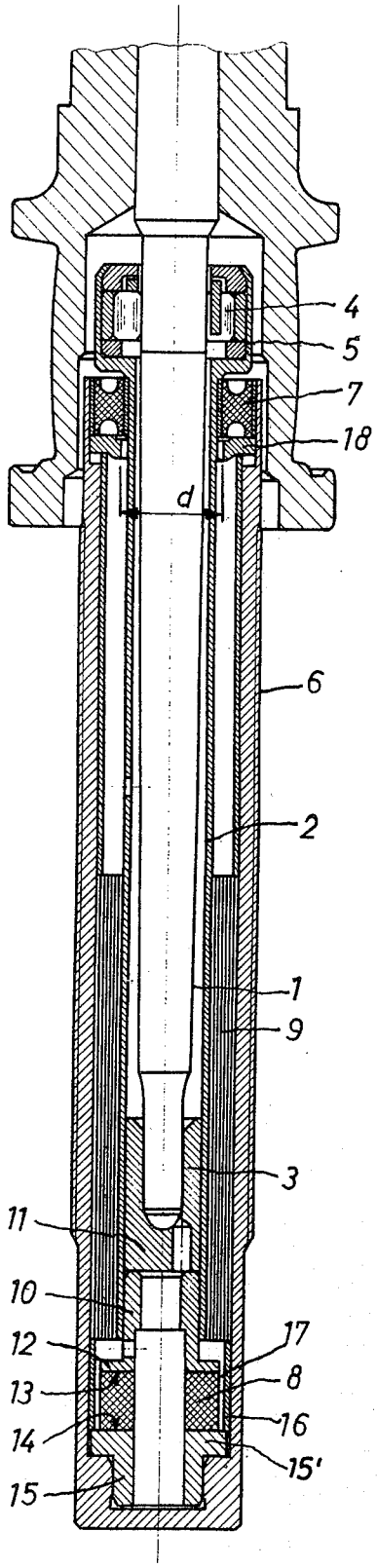
4
5
7
18
d
6
2
1
9
3
11
10
12
13
14
15
17
8
16
15'

TEXTILE SPINDLE

BACKGROUND OF THE INVENTION

The present invention relates to a new and improved construction of textile spindle of the type incorporating a spindle housing supporting a collar bearing and a footstep bearing through the agency of elastic bearing elements formed of resilient material.

In German Pat. No. 1,118,669 there is taught to the art a textile spindle of this type wherein the collar bearing and footstep bearing are directly supported via the elastic bearing elements at the spindle housing.

SUMMARY OF THE INVENTION

It is a primary object of the present invention to provide an improved construction of such type textile spindle.

Another and more specific object of the present invention aims at the provision of a new and improved construction of textile spindle which, without the need for any appreciable considerable expenditure, i.e. while retaining a simple construction, permits operations at very high rotational speeds.

Now in order to implement these and still further objects of the invention, which will become more readily apparent as the description proceeds, the invention contemplates a textile spindle of the previously mentioned type wherein the bearing elements support a rigid bearing or support tube which houses the collar bearing and the footstep bearing.

According to a further advantageous constructional manifestation of the invention the bearing tube is surrounded at the region of at least one of the bearing elements by a damping element.

According to a preferred embodiment of the invention the upper bearing element which neighbors the collar or neck bearing is constructed as a ring member, the effective cross-section of which possesses approximately the same dimensions in the axial and radial direction. The lower bearing element which neighbors the footstep or vertical bearing can be constructed so as to take-up axial- or compressive forces which are produced especially by the weight of the spindle and at the same time to take-up radial- or thrust forces. For the purpose of taking-up the thrust forces there is maintained free a ring-shaped or annular gap between the outer circumference of the lower bearing element and a stop accommodated in the spindle housing for limiting the radial deflection. The lower bearing element is thus preferably connected with its upper side or surface at a portion which is axially displaceable relative to the bearing tube however radially non-displaceable and with its lower side or surface at a portion of the spindle housing. The lower bearing element can also only bear against the aforementioned portions. This is sufficient for transmitting the thrust forces which do not exceed the frictional forces between the mutually contacting surfaces and brought about by the weight of the spindle and which is sufficient for transmitting the compressive or pressure forces in axial direction.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE of the drawing illustrates an axial sectional view of a preferred exemplary embodiment of textile spindle designed according to the teachings of the present invention.

DETAILED DESCRIPTION OF THE PREFERRED EMBODIMENTS

Describing now the drawing, the actual textile spindle has been conveniently designated by reference numeral 1. The rotatable spindle 1 is coaxially housed within a rigid, nonrotatable bearing or support tube 2 and in relation to such bearing tube is mounted in a footstep or vertical bearing 3 constructed as a sliding bearing and at its upper end in a roller bearing 4 received at a widened portion 5 at the upper end of the rigid bearing or support tube 2.

The rigid bearing tube 2 is supported in a likewise tubular-shaped spindle housing 6 through the agency of elastic bearing elements 7, 8 formed of a resilient or yielding material such as rubber for instance. Between the lower end of the rigid bearing tube 2 and the spindle housing 6 there is arranged a conventional damping element, for instance in the form of a spiral coil or spring 9.

The rigid bearing tube 2 is not directly supported at the lower ring-shaped bearing element 8. In fact, it will be observed that in the lower open end of the rigid bearing tube 2 there is accommodated so as to be axially displaceable and radially non-displaceable a sleeve 10 against which bears the lower end or surface 11 of the footstep bearing 3, and which sleeve possesses a flange 12. The lower bearing element 8 is accommodated between the lower surface 13 of the flange 12 and the upper surface 14 of a flange 15' provided at a housing-fixed sleeve 15.

Between the outer circumference or periphery of the lower bearing element 8 and the spindle housing 6, and in the embodiment under discussion between the outer circumference of the lower bearing element 8 and a spacer sleeve 16 arranged in the spindle housing 6 there is left free a ring-shaped or annular gap 17. The bearing element 8 can be fixedly connected, for instance adhesively bonded, with the surfaces 13 and 14. The weight of the spindle acts via the footstep bearing 3 and the sleeve 10 upon the bearing element 8 and squeezes such together in the axial direction. The compressive force produces a frictional force between the end surfaces of the bearing element 8 and the surfaces 13, 14 which counteract a transverse displacement of the bearing element between the sleeves 10 and 15 when there is present a thrust load. In those instances where such thrust load, for instance owing to bending oscillations of the spindle 1, is smaller than the frictional forces, then, it is also sufficient if there is provided a loose reception of the bearing element between the sleeves 10 and 15. The bearing element 8 could also be positively radially held or centered at one of the components, for instance in that a collar or pin at one of the sleeves 10, 15 piercingly extends for a certain distance into the bore of the ring-shaped bearing element. It is also to be recognized that instead of constructing the bearing element 8 so as to be ring-shaped it could be designed so as to also be completely cylindrical or a solid cylinder.

The described construction of textile spindle allows operating the spindle 1 at very high rotational speeds. It has been found that the two primarily effective critical rotational speeds are sufficiently below the operating rotational speed and it is possible to pass through such rotational speeds without disturbance. The bearing elements are dimensioned such that they are capable of withstanding the belt pull or tension.

Below the upper bearing element 7 there is mounted a ring member or ring 18 in the spindle housing 6. The inner diameter d of the ring member 18 is greater than the outer diameter of the bearing or support tube 2 at this location, so that between the ring member 18 and the bearing tube 2 there is present a ring-shaped or annular gap. The ring member 18 thus forms a deflection stop or limit means for the bearing tube 2 at the upper end of the housing 6, similar to the stop provided via the gap 17 at the lower bearing element 8.

While there is shown and described present preferred embodiments of the invention, it is to be distinctly understood that the invention is not limited thereto but may otherwise variously embodied and practiced within the scope of the following claims. ACCORDINGLY,

What is claimed is:

1. A textile spindle comprising:

a elongate tubular spindle housing;

a first elastic bearing element fitted in the housing at one end thereof;

a second elastic bearing element fitted in the housing at the other end thereof and located between first and second engagement members;

a rigid support tube extending within the housing and supported therein by the first and second elastic bearing elements, the rigid support tube having one end region protruding from said one end of the housing and being enlarged at said one end region, and the first engagement member being between the second elastic bearing element and the support tube and being connected to the support tube in such a manner that it is displaceable axially of the support tube yet is substantially fixed against displacement radially thereof;

a collar bearing fitted in the enlarged end region of the support tube;

a footstep bearing fitted in the support tube at the other end thereof; and a spindle blade supported within the rigid support tube by the footstep bearing and the collar bearing.

2. A textile spindle as claimed in claim 1, wherein said first elastic bearing element is in the form of a ring accommodated in the spindle housing and surrounding the rigid support tube, the effective cross-section of the ring having substantially the same axial dimension as its radial dimension.

3. A textile spindle as claimed in claim 2, comprising a ring member mounted in the spindle housing and surrounding the rigid support tube between the first elastic bearing element and the second elastic bearing element, the internal diameter of the ring member being larger than the external diameter of the support tube where it is surrounded by the ring member.

4. A textile spindle as claimed in claim 1, wherein the first engagement member has a rod-form portion fitted in the support tube at said other end thereof and a flange portion having a main face directed away from the rod-form portion and engaging the second elastic bearing element.

5. A textile spindle as claimed in claim 1, wherein the second elastic bearing element and the first and second engagement members are each of generally circular cross-section, the maximum diameter of the first engagement member being approximately equal to the maximum diameter of the second elastic bearing element but being smaller than the maximum diameter of the second engagement member.

6. A textile spindle as claimed in claim 5, wherein a substantially ring-shaped gap is maintained free surrounding the first engagement member and the second elastic bearing element, and the gap is bounded by a stop for limiting radial deflection of the second elastic bearing element.

7. A textile spindle as claimed in claim 6, comprising a ring-shaped damping element mounted in the housing and surrounding a region of the support tube at said other end thereof, and a spacer sleeve surrounding the second elastic bearing element and the first engagement member and extending between the second engagement member and the damping element.

8. A textile spindle as claimed in claim 1, wherein the second elastic bearing element has opposite surfaces secured to the first and second engagement members respectively.

9. A textile spindle as claimed in claim 1, wherein the second elastic bearing element is ring-shaped.

* * * * *